US007695102B2

(12) United States Patent
Schneider et al.

(10) Patent No.: US 7,695,102 B2
(45) Date of Patent: Apr. 13, 2010

(54) BEARING

(75) Inventors: Tanya Schneider, Vancouver, WA (US); Joseph E Scheffelin, Poway, CA (US); Dale Dean Timm, Jr., Solana Beach, CA (US); Paul Mark Haines, Lebanon, OR (US); Ronald J. Ender, Corvallis, OR (US); Craig Malik, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1162 days.

(21) Appl. No.: 11/103,683

(22) Filed: Apr. 12, 2005

(65) Prior Publication Data

US 2006/0227164 A1 Oct. 12, 2006

(51) Int. Cl.
*B41J 23/00* (2006.01)

(52) U.S. Cl. ..... 347/37

(58) Field of Classification Search ..... 347/37, 347/104

See application file for complete search history.

(56) References Cited

U.S. PATENT DOCUMENTS

| | | | | |
|---|---|---|---|---|
| 3,557,694 | A | 1/1971 | Wallace | |
| 4,350,448 | A | 9/1982 | Hanagata | |
| 4,914,453 | A * | 4/1990 | Kanayama et al. | 347/86 |
| 5,468,080 | A * | 11/1995 | Jones | 400/618 |
| 5,923,350 | A * | 7/1999 | Ohnishi et al. | 347/50 |
| 6,015,211 | A * | 1/2000 | Kinoshita et al. | 347/109 |
| 6,637,863 | B2 | 10/2003 | Jones | |
| 6,769,825 | B2 | 8/2004 | Strohdiek | |
| 7,220,068 | B2 * | 5/2007 | Silverbrook | 400/88 |

* cited by examiner

*Primary Examiner*—An H Do

(57) ABSTRACT

Embodiments of an apparatus including a rolling contact bearing are disclosed.

22 Claims, 7 Drawing Sheets

BEARING

BACKGROUND

Fluid ejecting devices, such as printheads, are used to deposit ink upon media, Improper positioning of the printheads within an imaging device may adversely affect print quality, device operation, or both. Imaging device components for positioning or securing printheads within the device are sometimes inadequate.

DETAILED DESCRIPTION OF THE EXAMPLE EMBODIMENTS

Figure 1:
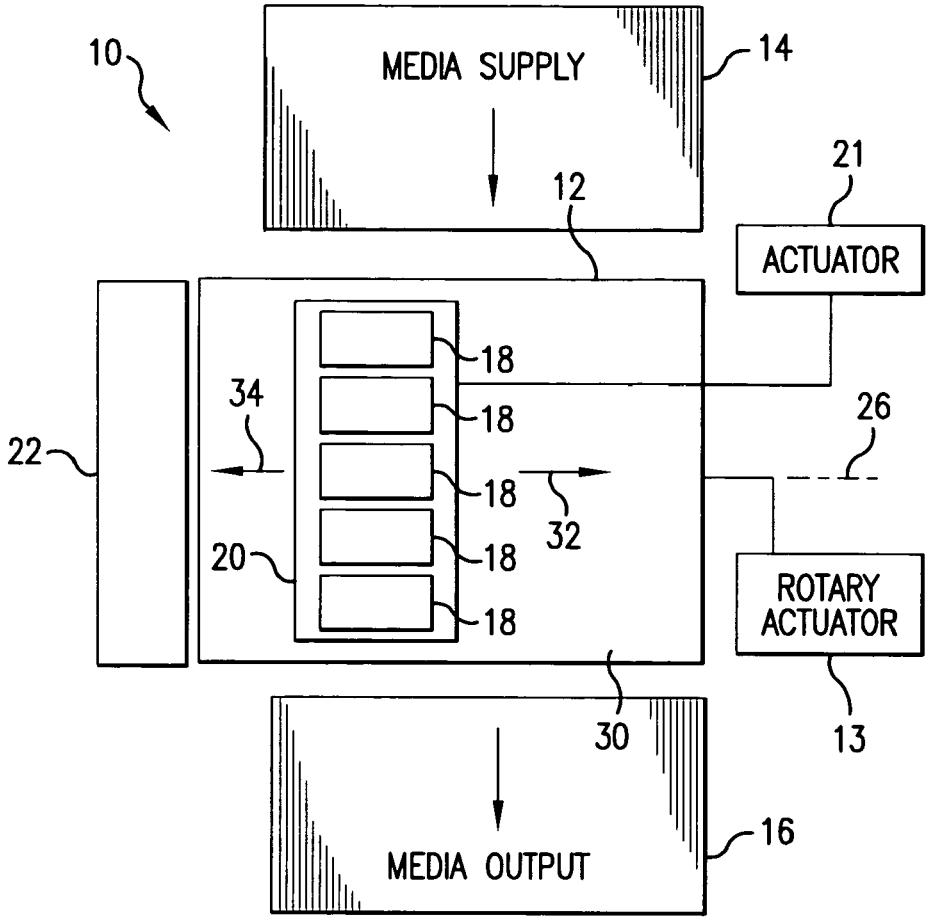
FIG. 1 is a schematic illustration of a printing system according to an example embodiment.
Figure 2:
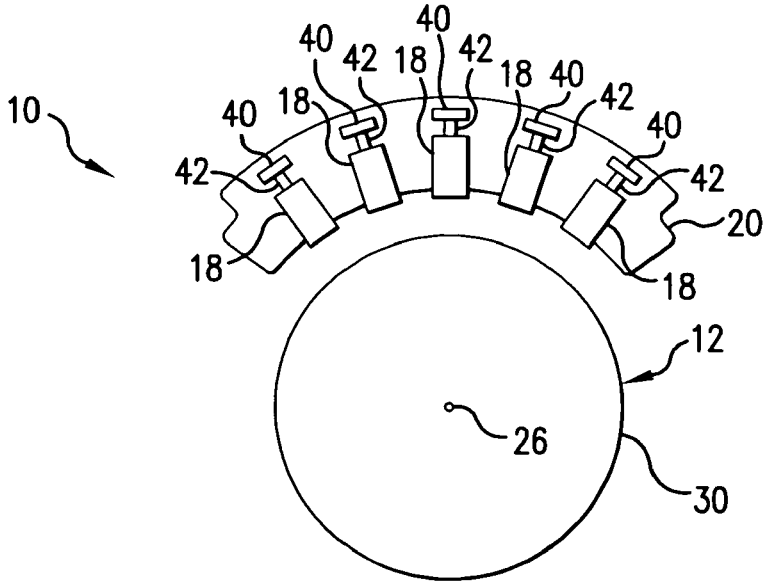
FIG. 2 is another schematic illustration of the printing system of FIG. 1 according to an example embodiment.

FIGS. 1 and 2 schematically illustrate printing system 10 according to one exemplary embodiment. Printing system 10 generally includes drum 12, rotary actuator 13, media supply 14, media output 16, pens 18, carriage 20, actuator 21, and service station 22. Drum 12 generally comprises an elongated cylinder configured to be rotatably driven about axis 26 by rotary actuator 13 while transporting media, such as paper, about axis 26 relative to pens 18. The pens 18 may also be referred to as "print cartridges," "fluid ejection devices," or the like. Rotary actuator 13 comprises a source of torque, such as a motor, operably coupled to drum 12 by a transmission (not shown).

Media supply 14, schematically shown, comprises a mechanism configured to supply media to drum 12. In one embodiment, media supply 14 comprises a mechanism configured to pick an individual sheet of media from a stack of media sheets and to supply the individual sheet to drum 12 such that the supplied individual sheet is wrapped at least partially about drum 12. Media output 16, schematically shown, comprises a mechanism to withdraw printed-upon media from drum 12 and to transport withdrawn media to and contain withdrawn media within an output tray, bin or the like. Media supply 14 and media output 16 may each include one or more rollers, belts, or other suitable media handling members.

Pens 18 include printheads configured to dispense imaging material, such as ink, upon the media held by drum 12. In one embodiment, pens 18 comprise piezoelectric printheads. In another embodiment, pens 18 comprise thermal inkjet printheads. Other suitable types of printheads may also be employed. As shown by FIG. 2, pens 18 are arranged in an arc, or in arcuate fashion, about axis 26. In the particular embodiment illustrated, drum 12 has an outer surface 30 also arranged in an arc about axis 26. Pens 18 are arranged in an arc substantially identical to the arc in which surface 30 extends.

Carriage 20 comprises one or more structures configured to support pens 18 in the arcuate arrangement. In addition, carriage 20 is configured to movably support pens 18 along axis 26. Pursuant to some embodiments, separate pockets within the carriage 20 may be provided such that each pen 18 is positioned within a separate carriage pocket. Actuator 21 comprises a linear actuator configured to move carriage 20 and pens 18 along one or more carriage rods (not shown) in the directions indicated by arrows 32, 34 so as to selectively position pens 18 opposite to the media held by drum 12 or opposite to service station 22. In one embodiment, actuator 21 may comprise a motor configured to drive a toothed pulley in engagement with a toothed belt coupled to carriage 20. In another embodiment, actuator 21 may comprise other forms of a linear actuator using rack and pinion arrangements, hydraulic, pneumatic, electrical systems, or a combination of these. Although system 10 is illustrated as including five pens 18 supported by a single carriage 20, system 10 may alternatively include a greater or fewer number of such pens 18 supported by one or more carriages 20. The pens 18 may be aligned or offset from each other.

Service station 22 comprises a station located on an axial end of drum 12 such that carriage 20 may position pens 18 opposite, or adjacent, to station 22. Station 22 includes one or more components configured to perform servicing operations upon one or more of the pens 18. At the service station 22, servicing operations such as wiping and spitting may occur.

With reference to FIG. 2, latches 40 are associated with individual ones of the pens 18. The latches 40 hold the associated pens 18 in locations in the carriage 20 during operations such as printing and servicing. Each latch 40 includes a biased bearing 42 configured to apply rolling contact to the associated pen 18. The bearings 42 in some embodiments comprise roller bearings and, in other embodiments, comprise ball bearings. Each bearing 42 is biased toward an associated pen 18 to apply a force against the pen 18 to hold the pen 18 in a location within the carriage 20. The bearings 42 permit rolling contact between the bearings 42 and the associated pens 18 so as to have low friction between the bearings 42 and the associated pens 18. In some applications, reliable seating of the pen 18 within the carriage 20 may be obtained by having a coefficient of friction between the bearing 42 and an associated pen 18 to be in the range of about 0.03-0.05 and, in some embodiments about 0.04.

Figure 3:
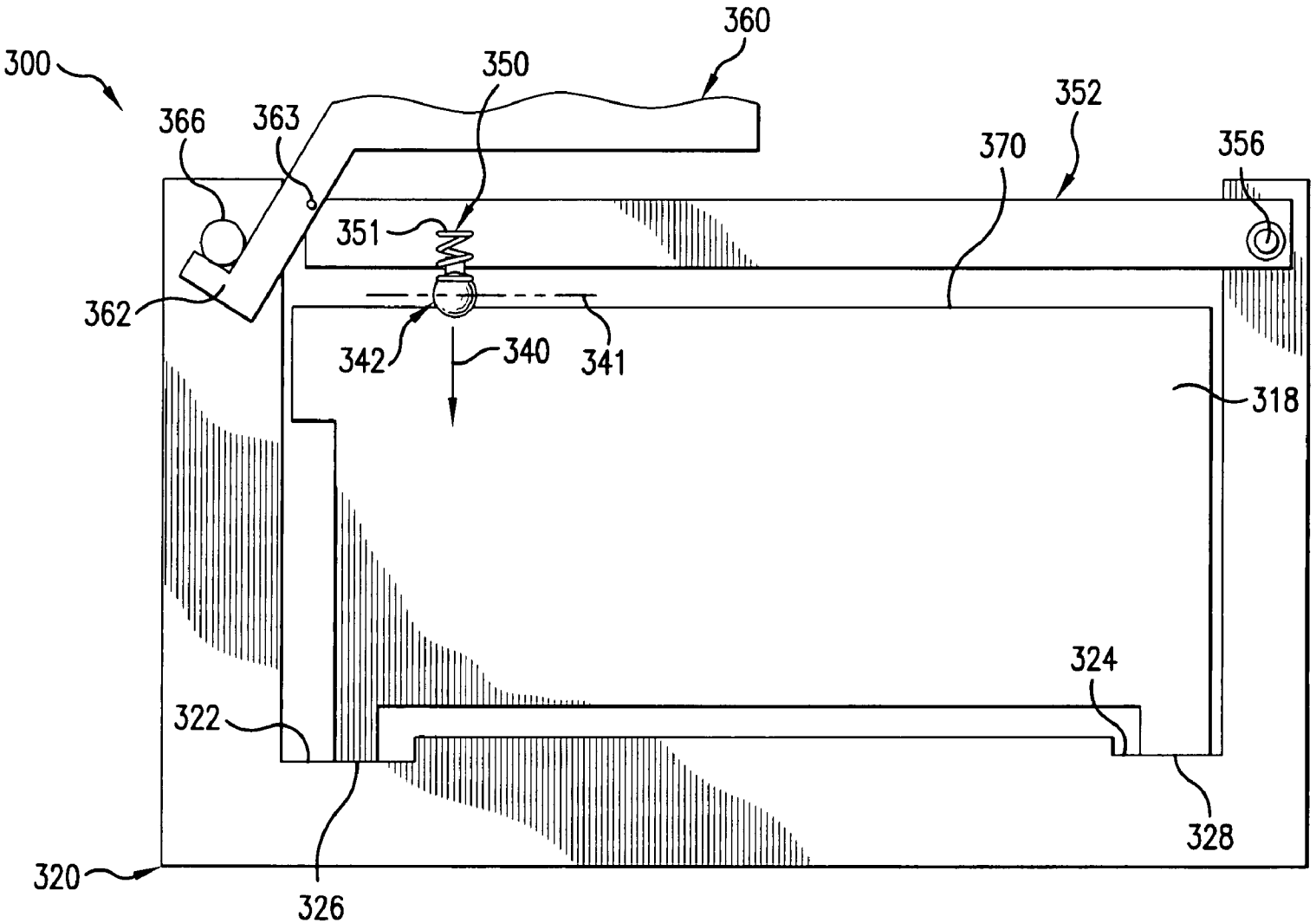
FIG. 3 is a schematic illustration of a latch according to an example embodiment.

FIG. 3 schematically illustrates an example embodiment of a latch system 300. As shown, a pen 318 is positioned within a carriage 320. In some embodiments, the carriage 320 comprises a discrete portion, or pocket, of a carriage, such as the carriage 20 (FIG. 1). The carriage 320 has datum surfaces 322, 324 for contacting and positioning datum surfaces 326, 328, respectively. A biased bearing 342 is provided and applies a force to the pen 318 substantially in direction 340. Application of a force substantially in direction 340 aids in seating the surfaces 326, 328 of the pen 318 on surfaces 322, 324 of the carriage 320, respectively. The biased bearing 342 may also aid in the seating of one or more other or additional, datum surfaces, according to some embodiments. The bearing 342 in the embodiment shown in FIG. 3 may, for example, comprise a ball bearing or a roller bearing. In embodiments where the bearing 342 comprises a roller bearing, the roller bearing may be configured to rotate about axis 341.

A bias member 350 is provided and is configured to provide a biasing force on the bearing 342 substantially in direction 340. The bias member 350 may comprise a spring or other suitable bias member.

The bias member 350 may be disposed between an arm 352 pivotally coupled to the carriage 320 at pin 356. In some embodiments, the bias member 350 may be secured to the arm 352 at end 351. Pursuant to this configuration, the bearing 342 may move into and out of contact with the pen 318 as the arm 352 rotates, or pivots, about pin 356. A handle 360 is pivotally attached to the arm 352 and includes a hook portion 362. The handle 360 is configured to pivot about axis 363. The hook portion 362 is configured to selectively engage a protrusion 366 as shown in FIG. 3. The protrusion 366 may comprise a post or other suitable structure for engaging the hook portion 362 of the handle 360.

When the handle 360 is positioned in the position shown in FIG. 3, the arm 352 exerts a force substantially in direction 340 on the bias member 350, which, in turn exerts a force on the bearing 342 that is directed substantially in the direction 340. This force from the bearing 342 on the surface 370 of the pen 318 aids in seating the surfaces 326, 328 on the surfaces 322, 324, respectively, and aids in maintaining the pen 318 properly positioned within the carriage 320 during printing operations, servicing operations, or both.

FIGS. 4-8 illustrate details of another example embodiment of a latch system 400. The latch system 400 is shown as including a handle 460, an arm 452, a carriage 420, a bias member 450, and a bearing 442. A removable pen 418 is shown as positioned at the carriage 420 and secured at the carriage by the bearing 442. The pen 418, in some embodiments, may include a fluid interconnect portion 419, which permits fluid conduits (not shown) to be coupled to the pen 418. Ink, or other suitable fluids, may be delivered to the pen 418 via the fluid interconnect portion 419.

The handle 460 is pivotally coupled to the arm 452 at pivot 480. The arm 452 is pivotally coupled to the carriage 420 at pivot 456. As shown in FIGS. 5-8, the handle 460 may include one or more hook portions 462 configured to selectively engage with one or more protrusions 466. The protrusions 466 may comprise posts or other suitable structure for engaging the hook portions 462. Additional details regarding the engagement of the hook portions 462 and the protrusions 466 are provided below.

Figure 4:
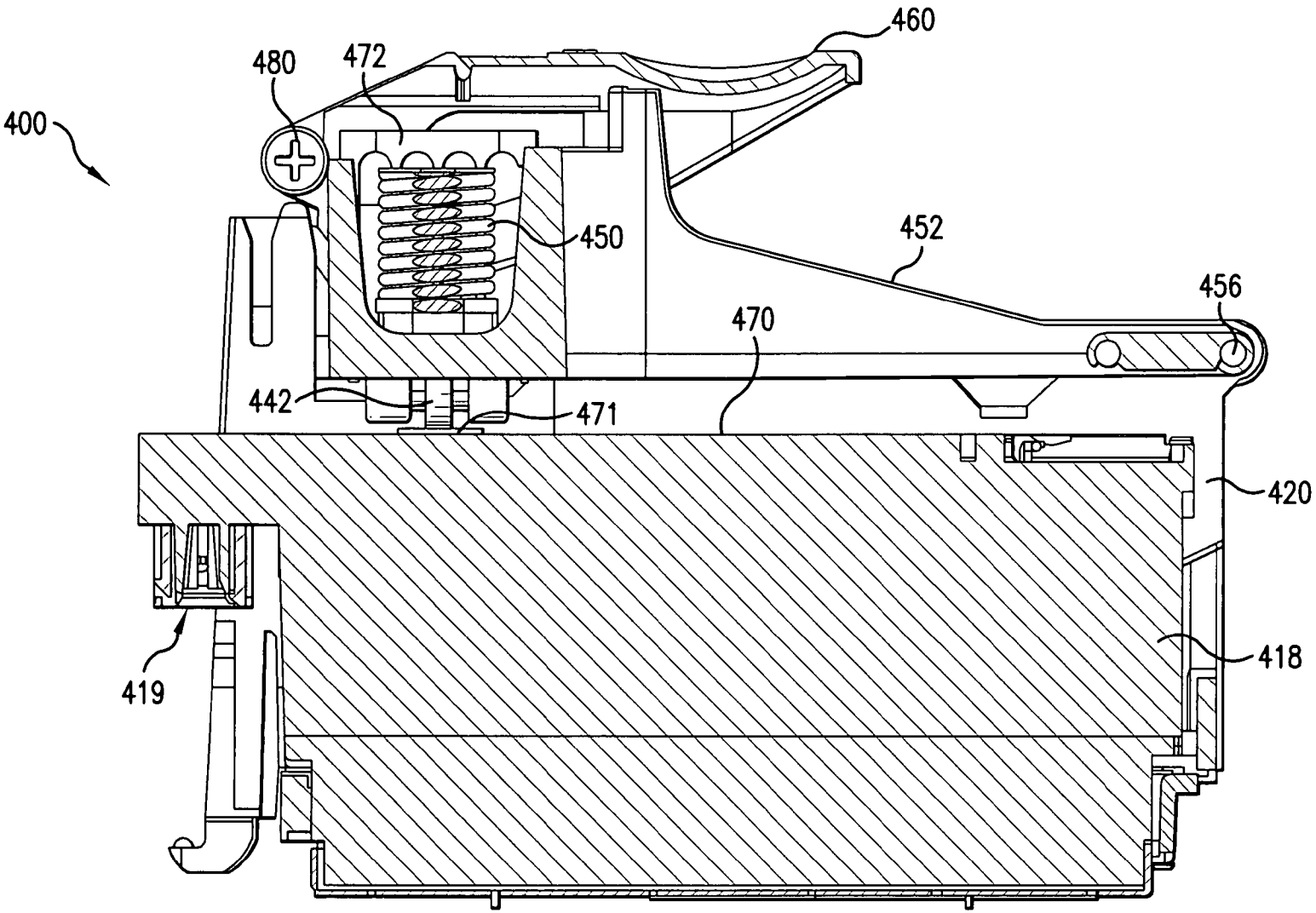
FIG. 4 is a sectional view of a latch according to an example embodiment.
Figure 5:
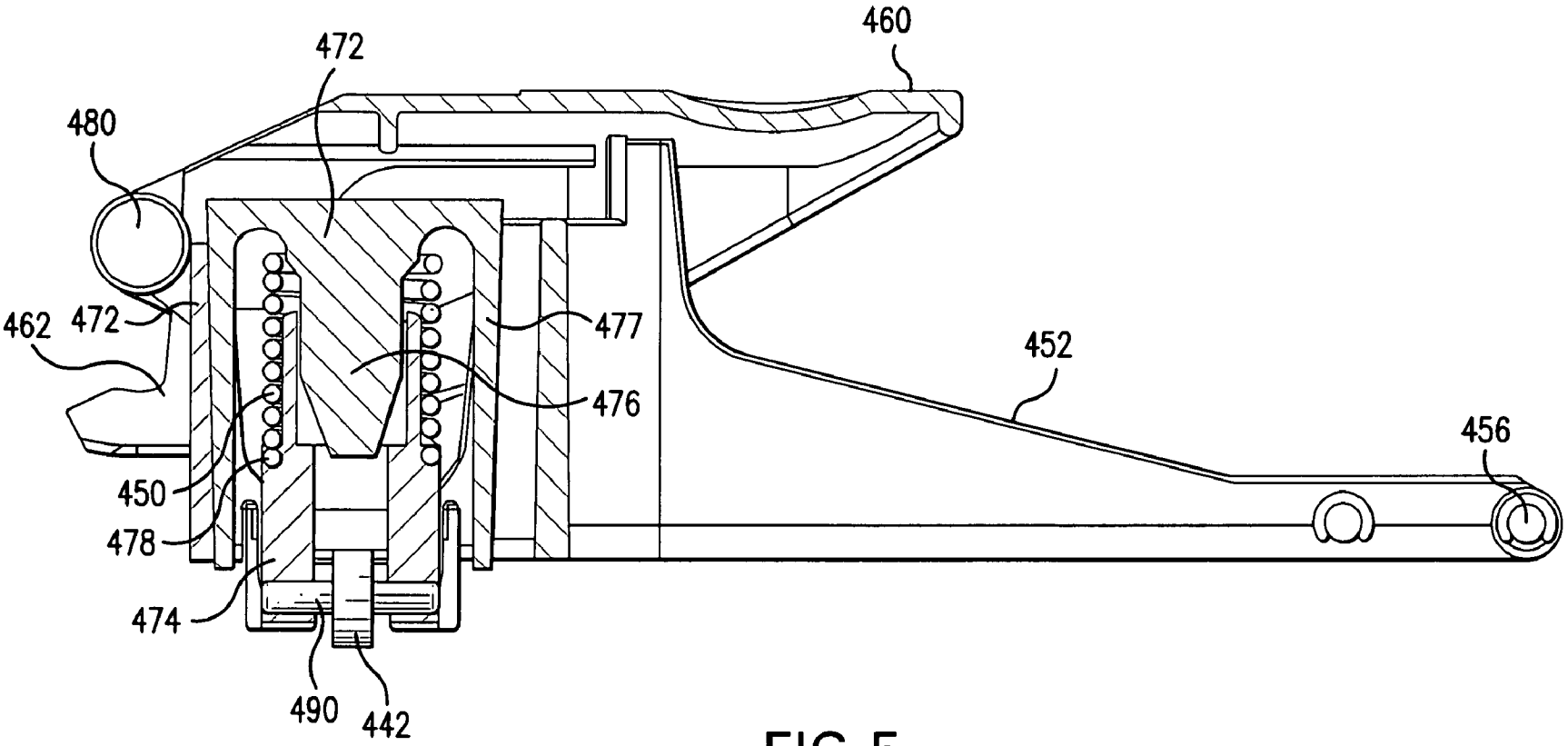
FIG. 5 is a sectional view of a portion of the latch of FIG. 5 according to an example embodiment.

With reference to FIGS. 4 and 5, a spring lock 472, a spring guide 474, and a bearing shaft 490 are secured to the arm 452. The spring lock 472 may be secured to the arm 452 by any suitable technique, including engaging snaps formed on the spring lock with the handle 460. As such, in some embodiments, the spring lock 472 does not move relative to the arm 452.

The bias member 450 shown in the system 400 comprises a helical spring disposed about a central region 476 of the spring lock 472. The bias member 450 is also disposed between side portions 477 of the lock 472. The spring lock 472 aids in maintaining the bias member 450 properly positioned relative to the arm 452. The spring guide 454 is slidably coupled to the central region 476 of the lock 472 and contacts the bias member 450 at locations 478. In some embodiments, the bias member 450 is secured to the spring guide 474 at the locations 478.

A bearing shaft 490 is secured to the spring guide 474 and is shown as being generally oriented such that the longitudinal axis of the shaft 490 is parallel with a longitudinal axis of the pen 418. The bearing 442, as shown in FIGS. 4-8 comprises a roller bearing rotatably mounted on the shaft 490 such that the bearing 442 may rotate about the shaft 490 in wheel-like fashion. Since the bearing 442 rotates about the shaft 490, the contact between the bearing 442 and the pen 418 is rolling contact rather than sliding contact in the directions into and out of the page.

In some embodiments, a pen surface 470 may have a support member 471, or landing pad, disposed thereon for contacting the bearing 442. Pursuant to some example embodiments, the bearing 442 may apply a force against the pen 418 in the range of 80-90 Newtons and in a particular example embodiment the force is about 85 Newtons. In some instances, the surface 470 of the pen 418 may be formed of plastic or some other material that may be deformed or damaged by high stresses, such as those that may be caused by forces of this magnitude contacting a small area of the surface 470 directly. The support member 471 is disposed on the surface 470 adjacent the bearing 442 to interface the bearing 442 and the surface 470 of the pen 418. The support member 471 may comprise, in some embodiments, a flat metal plate and may aid in spreading the force from the bearing 442 over a larger area of the surface 470. The support member 471 may have a smooth surface that results in a low coefficient of friction between the bearing 442 and the support member. The support member 471 is optional and may not be present in all embodiments.

Figure 6:
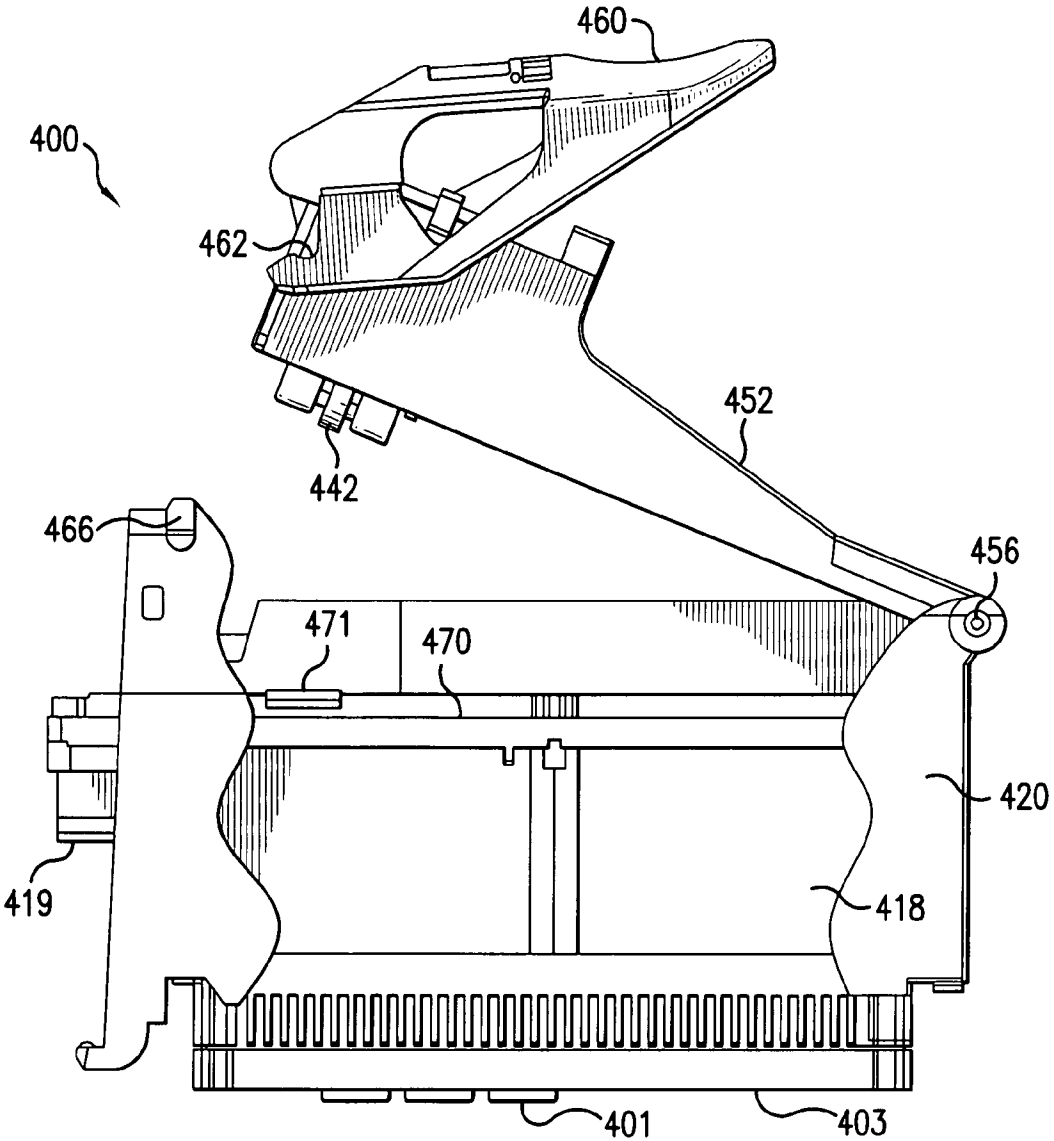
FIG. 6 is a side elevation view of a pen disposed in a carriage with a latch in an open position according to an example embodiment.

FIG. 6 illustrates the system 400 in an unlatched position with the pen 418 positioned in the carriage 420. As shown in FIG. 6, the handle 452 is pivoted, or rotated to a position away from the pen 418. In the position shown, the bias member 450 is substantially unbiased, or relaxed, and the bearing 442 is not in contact with the pen 418. One or more printheads 401 may be positioned at surface 403 of the pen 418. In embodiments where multiple printheads 401 are provided at the surface 403, the printheads 401 may be in either a staggered configuration or a non-staggered configuration. The specific configuration of the printheads 401 on the surface 403 may, of course, vary. In some applications, the printheads 401 may be referred to as "printhead dies" or simply as "dies."

Figure 7:
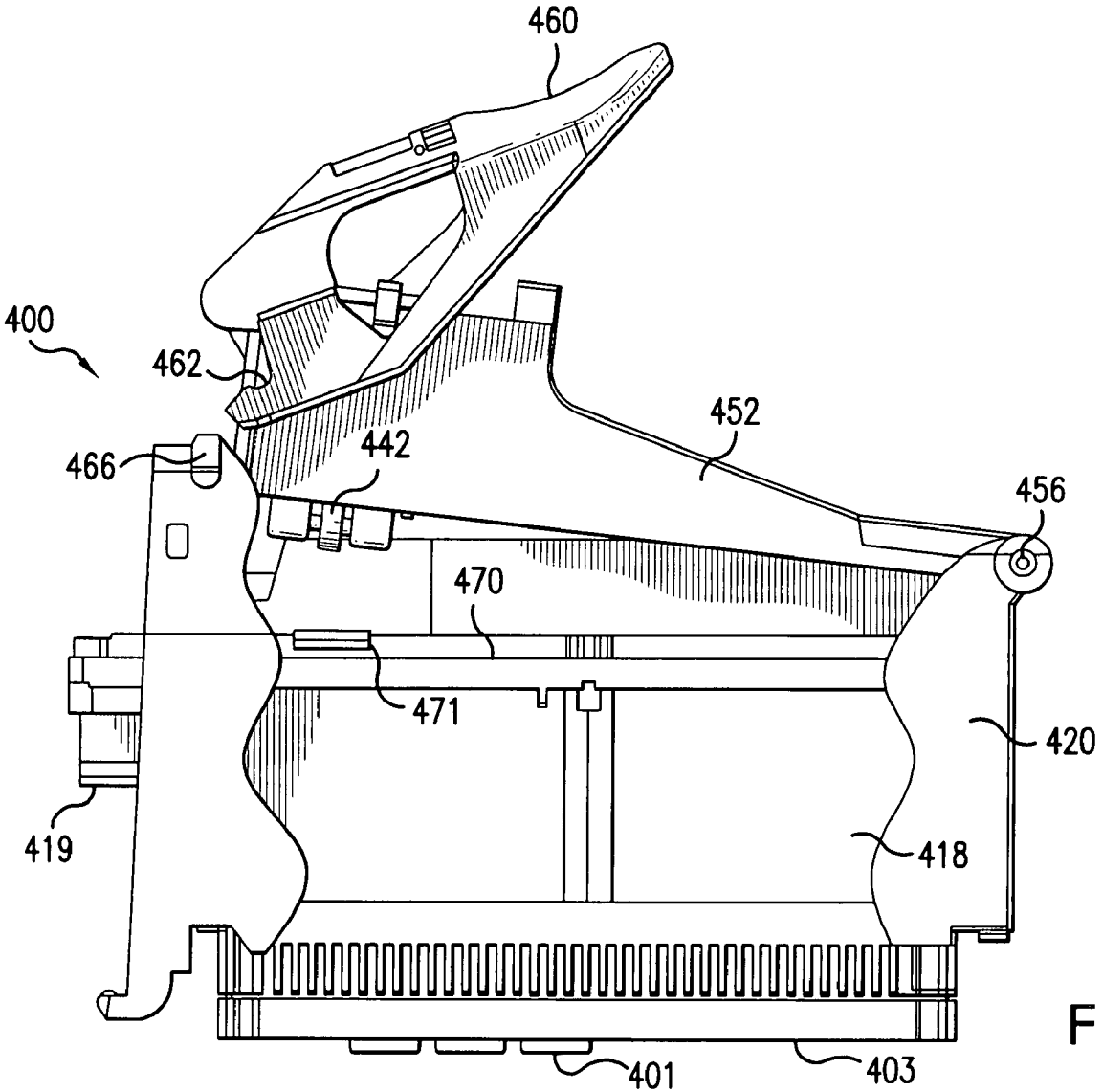
FIG. 7 is a side elevation view of a pen disposed in a carriage with a latch in an intermediate position according to an example embodiment.

FIG. 7 illustrates the system 400 in an unlatched position with the pen 418 positioned in the carriage 420. As shown in FIG. 7 the arm 452 is rotated toward the pen 418 compared to the position shown in FIG. 6. To move between the positions shown in FIGS. 6 and 7, the arm 452 pivots about pivot 456.

Figure 8:
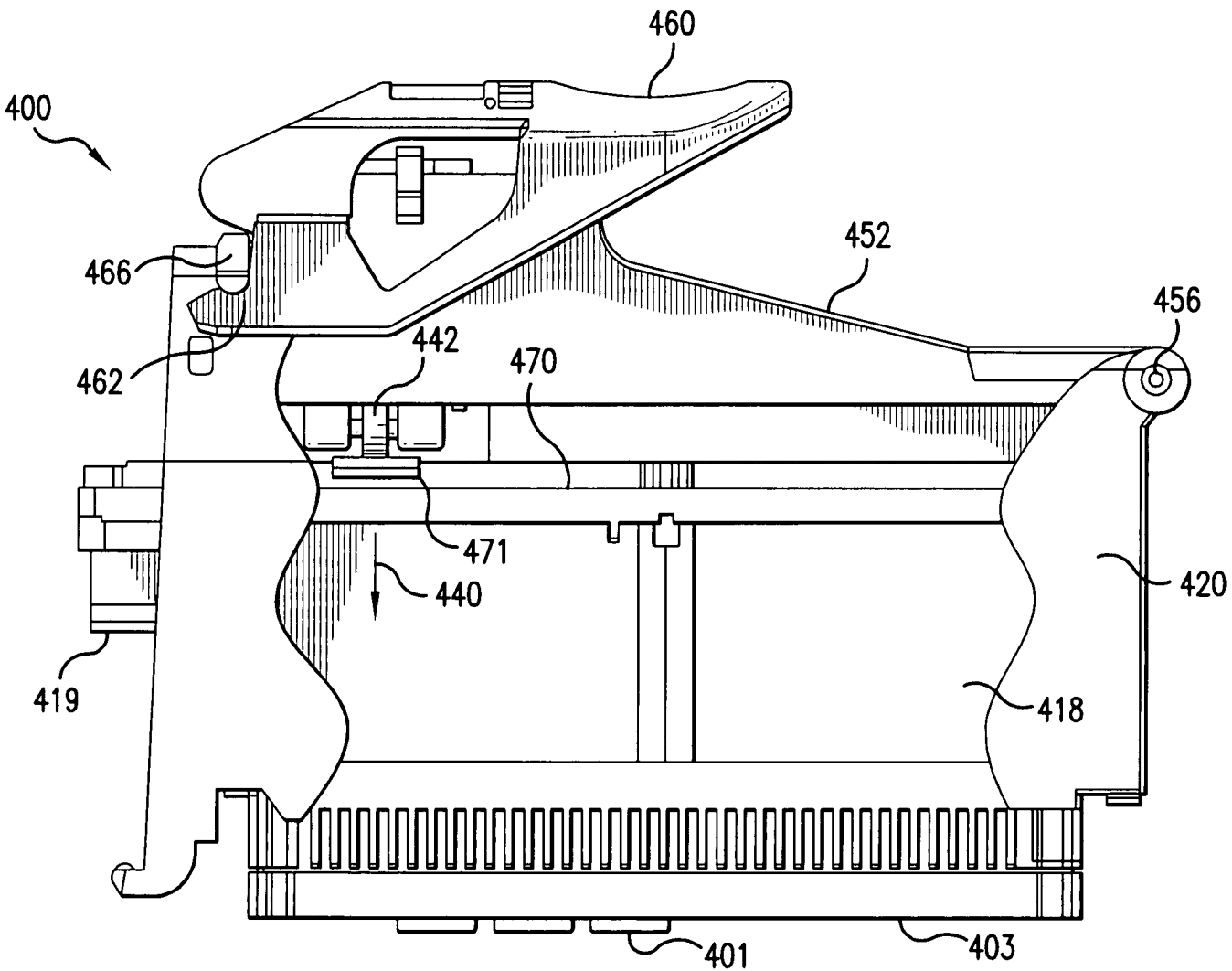
FIG. 8 is a side elevation view of a pen disposed in a carriage with a latch in a closed position according to an example embodiment.

FIG. 8 illustrates the system 400 in a latched position. In the position shown in FIG. 8, the pen 418 is maintained positioned in the carriage 420, at least in part, by the bearing 442. The bias member 450 (FIG. 5) is compressed between the pen 418 and the arm 452 with the hook portions 462 of the handle 460 engaged with the protrusions 466. With the handle 460 engaged with the protrusions 466, the arm 452 is positioned a distance from the pen surface 470 such that the bearing 442 is pushed into contact with the pen 418, or the support member 471 with the bias member 450 biased, or compressed. In this configuration, the bearing 442 applies a force substantially in the direction 440 to maintain the pen 418 positioned in the carriage 420.

To move the system 400 from the position of FIG. 7 to the position of FIG. 8, the arm 452 is rotated, or pivoted toward the surface 470 of pen 418. From the perspective shown in FIGS. 7 and 8, the arm 452 is rotated in a counter-clockwise direction as the handle 460 is moved from the FIG. 7 position to the FIG. 8 position. Once the hook portions 462 of handle 460 are proximate the protrusions 466, the handle 460 may be rotated, or pivoted in a clockwise direction to engage the hook portions 462 with the protrusions 466. As the hook portions 462 engage the protrusions 466 a downward force may be applied to the handle 460 to compress or further compress bias member 450. Pursuant to some embodiments, as the hook portions 462 engage with protrusions 466, the arm 452, and thus the spring lock 472 (FIG. 5), is moved closer to the pen 418, thereby compressing the bias member 450 and forcing the bearing 442 against the pen 418. With the handle 460 and the arm 452 in the positions shown in FIG. 8, the pen 418 may be held in the carriage 420 with little friction in the directions into and out of the page.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus, comprising:

a carriage;

a base pivotally coupled to the carriage; and a bearing coupled to the base and configured to secure a pen within the carriage with rolling contact, wherein the base is configured to pivot between a first position in which the bearing contacts the pen and a second position in which the bearing is out of contact with the pen.

2. The apparatus of claim 1, wherein the pen prints in a direction and wherein the apparatus further comprises a spring coupled to the bearing for biasing the bearing in the direction towards the pen.

3. The apparatus of claim 1 further comprising a manually contactable handle pivotally coupled to the base.

4. The apparatus of claim 1, further comprising:

a spring coupled to the bearing for biasing the bearing;

a handle pivotally coupled to the base for compressing the spring.

5. The apparatus of claim 1 further comprising a handle pivotally coupled to the base, the handle configured for selective engagement with the carriage.

6. The apparatus of claim 1, wherein the bearing comprises a wheel rotatably disposed on a shaft.

7. The apparatus of claim 1, further comprising a pen positioned within the carriage.

8. The apparatus of claim 1, wherein the pen comprises a metal landing pad, the bearing in contact with the metal landing pad.

9. The apparatus of claim 1, wherein the pen comprises a landing pad positioned on a surface of the pen, the bearing in contact with the landing pad.

10. The apparatus of claim 1, further comprising a drum platen configured such that media may be wrapped about the drum platen and positioned adjacent the carriage to advance media adjacent the carriage.

11. The apparatus of claim 1, further comprising:

multiple arms, each of the arms pivotally coupled to the carriage;

roller bearings, each of the roller bearings coupled to one of the arms.

12. The apparatus of claim 1, wherein the carriage is adapted to secure multiple pens in an arc.

13. The apparatus of claim 1, further comprising:

an arm pivotally coupled to the carriage;

a spring coupled to the carriage and configured to bias the bearing.

14. The apparatus of claim 1, wherein the bearing comprises a ball bearing.

15. A method, comprising:

removably positioning a pen within a housing, wherein the pen ejects fluid in a direction; and clamping a rotatable bearing into contact against the pen with a spring coupled to the bearing to bias the bearing in the direction towards the pen to secure the pen within the housing with rolling contact.

16. The method of claim 15, wherein the securing is performed by a roller bearing.

17. The method of claim 15, wherein the securing is performed by a ball bearing.

18. The method of claim 16, further comprising:

positioning multiple pens in the housing;

securing the multiple pens within the housing with multiple roller bearings.

19. The method of claim 15, wherein the securing further comprises clamping a roller bearing against the pen.

20. An image forming device, comprising:

a carriage configured to support a plurality of pens in arcuate positions; and latches pivotally coupled to the carriage, the latches having biased bearings for providing rolling contact with the pens.

21. An apparatus, comprising:

a carriage;

a base pivotally coupled to the carriage;

a bearing coupled to the base for securing a pen within the carriage with rolling contact; and a drum platen configured such that media may be wrapped about the drum platen and positioned adjacent the carriage to advance media adjacent the carriage.

22. A method, comprising:

removably positioning a pen within housing; and clamping a rotatable bearing into contact against the pen to secure the pen within the housing with rolling contact of a ball bearing.

* * * * *